US005743113A

United States Patent [19]

Kogen

[11] Patent Number: 5,743,113

[45] Date of Patent: Apr. 28, 1998

[54] PIERCED EARLOBE PROTECTOR

[75] Inventor: Robert A. Kogen, Elkins Park, Pa.

[73] Assignee: L. Lawrence Products, Inc., Huntingdon Valley, Pa.

[21] Appl. No.: 666,712

[22] Filed: Jun. 18, 1996

[51] Int. Cl.[6] ..... A44C 7/00

[52] U.S. Cl. ..... 63/12; 63/13

[58] Field of Search ..... 63/12.1, 13, 1.11, 63/33, 1.19

[56] References Cited

U.S. PATENT DOCUMENTS

| | | | |
|---|---|---|---|
| 4,593,540 | 6/1986 | Cuvar et al. . | |
| 4,829,788 | 5/1989 | DiDomenico . | |
| 5,018,365 | 5/1991 | Luceno | 63/12 |
| 5,154,068 | 10/1992 | DiDomenico . | |
| 5,365,754 | 11/1994 | Nalbandian | 63/12 X |
| 5,411,516 | 5/1995 | Thomas . | |

FOREIGN PATENT DOCUMENTS

| | | | |
|---|---|---|---|
| 9221262 | 12/1992 | WIPO | 63/12 |

*Primary Examiner*—Kien T. Nguyen
*Attorney, Agent, or Firm*—Caesar, Rivise, Bernstein, Cohen & Pokotilow, Ltd.

[57] ABSTRACT

A protector for use with a conventional pierced earring having a post. The protector is arranged for disposition within an opening extending through the earlobe of a person. The protector comprises a clutch member and a tubular flanged member. The clutch member has a hypoallergenic, e.g., titanium, flanged front portion, a rear portion, and a central passageway extending through it. Plural projections are mounted on spring fingers to extend into the central passageway of the clutch member. The tubular flanged member is formed of a hypoallergenic material, e.g., titanium, and has a flanged front portion and an elongated rear portion. The elongated rear portion has a free end having a pair of annular recesses extending thereabout. The free end of the rear portion of the tubular flanged member is arranged to be extended through the opening in the person's earlobe so that one of the recesses receives a portion of the clutch member contiguous with the central passageway to snap fit the flanged tubular member to the clutch member. The flanged portion of the flanged tubular member is arranged for disposition adjacent the front surface of the earlobe while the flanged portion of the clutch member engages the rear surface of the earlobe. The flanged tubular member has a central passageway extending therethrough for receipt of the post of the earring. When the post of the earring is extended through the central passageway in the flanged tubular member and into the central passageway of the clutch member it is frictionally engaged by the projections to hold it in place.

9 Claims, 1 Drawing Sheet

FIG. 1
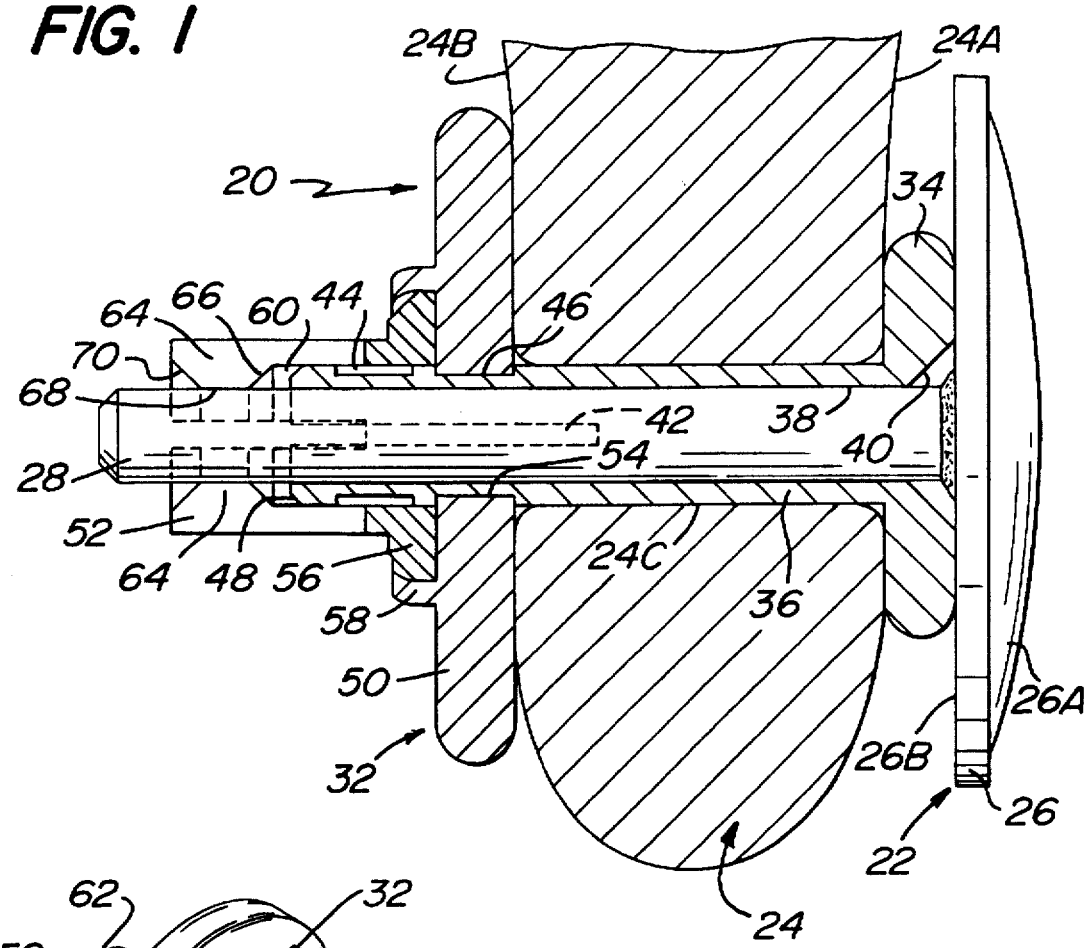
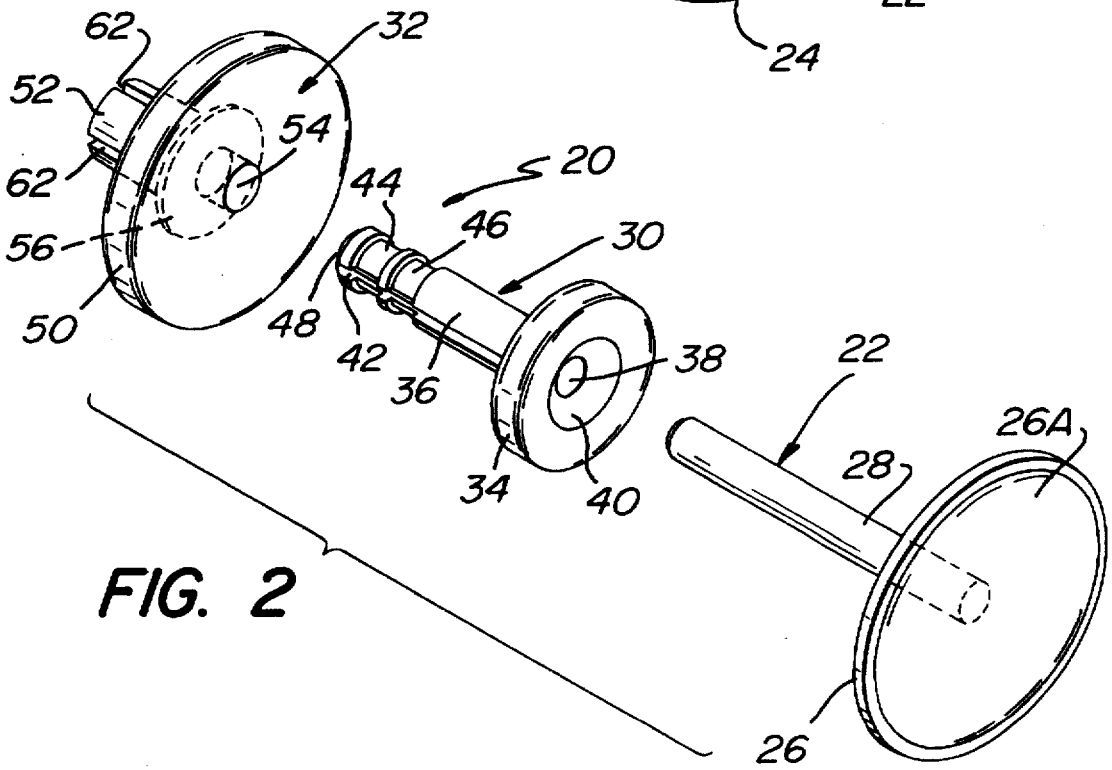
FIG. 2

PIERCED EARLOBE PROTECTOR

BACKGROUND OF THE INVENTION

This invention relates generally to pierced earrings and more particularly to protectors for protecting the earlobe of a person wearing a pierced earring.

Pierced earrings typically comprise a decorative member arranged to be disposed on the front surface of the ear lobe and a post mounted on the back of the decorative member and arranged to be extended through an opening or hole which has been pierced in the wearer's earlobe. Some type of retainer back or clutch is typically used on the post to engage the post behind the rear surface of the wearer's earlobe to hold the earring in place.

Inasmuch as the post of the earring passes through the pierced opening in the wearer's earlobe, irritation and/or infection may sometimes occur, particularly if the post is not formed of a hypoallergenic material (as is commonly the case).

The prior art includes various protectors in the form of sleeves, tubes or other inserts arranged to be disposed within the pierced opening in the wearer's ear for supporting a pierced earring post therein. Examples of such prior art devices are disclosed in U.S. Pat. Nos.: 4,593,540 (Cuvar et al.), 4,829,788 (DiDomenico), 5,411,516 (Thomas), and 5,154,068 (DiDomenico).

While the foregoing devices may be generally suitable for their intended purposes they never the less leave much to be desired from one or more of various standpoints, such as, ruggedness of construction, ease of placement and removal, ability to accommodate various thickness earlobes, resistance to accidental dislodgement, ability to be kept in place comfortably and safely for long periods of time, and secure holding of the earring therein.

OBJECTS OF THE INVENTION

Accordingly, it is a general object of this invention to provide a pierced earlobe protector which overcomes the disadvantages of the prior art.

It is a further object of this invention to provide a pierced earlobe protector which is simple in construction and easy to place in and remove from the wearer's earlobe.

It is a further object of this invention to provide a pierced earlobe protector of a low component count to facilitate its connection, e.g., it includes only two components which can be readily snap fit together to place it in position in the wearer's earlobe.

It is a further object of this invention to provide a pierced earlobe protector formed of hypoallergenic materials, yet which are rugged and suitable for long term use.

It is a further object of this invention to provide a pierced earlobe protector which is arranged for mounting a conventional pierced earring and to hold it securely in place without requiring the use of the earring's retainer back.

SUMMARY OF THE INVENTION

These and other objects of this invention are achieved by providing a pierced earlobe protector for disposition within an opening extending through the earlobe of a person from the front surface of the earlobe to the rear surface thereof. The protector is arranged to hold a conventional pierced earring including a decorative portion and a post projecting therefrom.

The protector basically comprises a clutch member and a flanged tubular member. The clutch member has a flanged front portion, a rear portion, and a central passageway extending through it. At least one projection extends from the clutch member into its central passageway.

The flanged tubular member has a flanged portion and an elongated portion extending from the flanged portion. The elongated portion has a free end and is arranged to be extended through the opening in the person's earlobe. The flanged tubular member also has a central passageway extending through it. The flanged portion of the flanged tubular member is arranged for disposition adjacent the front surface of the earlobe when the elongated portion of the flanged tubular is extended through the opening in the earlobe.

The free end of the elongated portion of the flanged tubular member includes at least one recess therein for receipt of a portion of the clutch member to snap fit the flanged tubular member to the clutch member, whereupon the flanged portion of the clutch member engages the rear surface of the earlobe and prevents the protector from becoming dislodged out of the earlobe opening.

The post of the earring is arranged to be extended through the central passageway in the flanged tubular member and into the central passageway of the clutch member to be frictionally engaged by the at least one projection.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a side elevational view, partially in section, showing the earlobe protector of this invention in place in the earlobe of a person, and having a conventional pierced earring supported thereby; and FIG. 2 is a reduced size, exploded isometric view of the earlobe protector and pierced earring shown in FIG. 1.

DETAILED DESCRIPTION OF THE PREFERRED EMBODIMENTS

Referring now to various figures of the drawing where like reference numerals refer to like parts there is shown at 20 in FIG. 1 a pierced earlobe protector constructed in accordance with this invention for mounting a pierced earring 22 in the earlobe 24 of a person.

The earring 22 is a conventional device, which basically comprises a decorative member or element 26 and a post 28 having a pointed free end. The decorative element 26 may take any shape, depending upon the desired aesthetics, but typically comprises a disk like member having a front surface 26A, which is decorative, e.g., is a jewel, and a planar rear surface 26B. The post 28 is mounted, e.g., welded, soldered, or otherwise affixed, on the rear surface 26B of the member 26 and projects normally from that surface. The rear surface 26B of the earring is arranged to be located closely adjacent the front surface 24A of the wearer's earlobe, while the post 28 extends through a pierced opening 24C in the earlobe to a point beyond the rear surface 24B of the earlobe.

The earlobe protector 20 basically comprises a flanged tubular member 30 and a clutch member 32 which are arranged to be connected to each other within the opening 24C in the earlobe in order to install the protector and ready it to accommodate the pierced earring 22.

In the interests of comfort and to minimize, if not eliminate, any irritation to the wearer's earlobe contiguous with the opening 24C, portions of the protector 20 (to be described later) are formed of a hypoallergenic material. Preferably that material is titanium, since titanium exhibits very high strength and ruggedness, while also being readily cleanable. The later feature is of importance in the interests of sanitation.

The flanged tubular member 30 includes a flanged front end portion 34 and an elongated rear portion 36 and is preferably formed as an integral member of titanium. The rear portion is in the form of an elongated tube having a central passageway 38 extending through it and through the center of the flanged front end portion 34. The inner diameter of the passageway 38 is just slightly larger than the outer diameter of a typical pierced earring post 28, to readily accommodate the post therein. The front surface of the flanged front end portion contiguous with the central passageway 38 is in the form of a conical recess 40 to facilitate the insertion of the post 28 of the earring into the passageway 38.

A pair of diametrically opposed linear slots 42 extend longitudinally from the free end of the elongated rear portion 36 of the flanged tubular member 30 to an intermediate point thereon. These slots effectively split the free end of the elongated rear portion 36 so that the split portions can flex slightly with respect to each other to facilitate the insertion of the free end of the flanged tubular member 30 into the clutch member 32 (as will be described later). A pair of annular recesses 44 and 46 are provided in the outer surface of the of the elongated rear portion 36 of the flanged tubular member adjacent its free end. Each of these recesses is of a width and depth to accommodate a portion (to be described later) of the clutch member 32 when the flanged tubular member is connected to the clutch member. The free end of the flanged tubular member is chamfered at 46 to facilitate the insertion of the free end of the flanged tubular member 30 into the clutch member 32.

As can be seen clearly in FIG. 1, the clutch member basically comprises a flanged front portion 50 and a rear portion 52. A central passageway 54 extends through the front portion, and another central passageway (to be described later) extends through the rear portion. These two passageways are axially aligned so that together they form a central passageway extending through the entire clutch member from the front surface of the flanged front portion 50 to the rear surface of the rear portion 52. The inner diameter of the portion of the central passageway 54 which extends through the flanged front portion 50 is approximately the same the outer diameter of the bottom of each of the annular recesses 44 and 46 in the free end portion of the flanged tubular member 30. Moreover, the thickness of the flanged front portion 50 is approximately the same as the width of either of those annular recesses in order to enable either of those recesses to accommodate the flanged front portion 50 of the clutch member 32 therein.

The rear portion 52 of the clutch member 32 comprises a tubular member formed of a resilient material, e.g., beryllium-copper, having a circular disk-like flange 56 at the front end thereof. The disk-like flange 56 is located within an upstanding annular wall 58 in the rear surface of the flanged front portion 50 of the clutch member 32. The annular wall is deformed, e.g., swedged, about the disk-like flange 56 to fixedly secure the rear portion 52 of the clutch member to the flanged front portion, and thereby form an integral unit.

As can be seen clearly in FIG. 1 the rear portion 52 of the clutch member is hollow to define a central passageway 60 therethrough. The central passageway 60 is axially aligned with the central passageway 54 in the flanged front portion 50, and is of an inner diameter approximately the same as the outer diameter of the elongated rear portion 36 of the flanged tubular member 30 to accommodate the free end thereof therein as shown in FIG. 1.

Four linear slots 62 extend longitudinally from the free end of the rear portion 52 of the clutch member 32 to a point closely adjacent the front disk-like flange 56. The slots 62 are equidistantly disposed with respect to one another to effectively split the rear end of the rear portion 52 into four spring-like fingers. The fingers are arranged to flex slightly outward radially to facilitate the frictional engagement of the earring's post 28 by the clutch member 32, and thereby securely hold the earring in place without the need for any earring retainer back. To that end, as can be seen clearly in FIG. 1, the inner surface of each of the fingers which is contiguous with the central opening 60 is in the form of a respective projection 64. Each projection 64 includes a cammed or upwardly inclined leading surface 66, a planar top surface 68 for frictionally engaging the earring's post 28, and a cammed or downwardly inclined trailing surface 70.

The earring protector 20 is used as follows: The flanged tubular member 30 is held by the user and its elongated rear end portion 36 is inserted from the front of the earlobe into the pierced opening 24C. When properly positioned the free end of the elongated rear portion 36 of the flanged tubular member 30 extends beyond the rear surface 24B of the earlobe. The clutch member 32 is then applied from the rear of the user's earlobe so that the extending free end portion of the flanged tubular member 30 is received within the central passageway 38 in the clutch member. The split nature of the free end portion of the flanged tubular member 30 facilitates the insertion process by enabling the split portions to flex slightly inward, thereby reducing the diameter of the free end portion. The two components are then pressed together until the central passageway portion 54 of the clutch member 32 is snap-fit in either of the annular recesses 44 and 46. The particular recess to be used is selected so that the spacing between the flanged front 34 of the flanged tubular member 30 and the flanged front 50 of the clutch member are as close together as possible while comfortably sandwiching the user's earlobe therebetween. Normally, persons with thinner earlobes will utilize the recess 46, while those with thicker earlobes will use the recess 44. It should be pointed out at this juncture that additional recesses can be used to accommodate a wider range of earlobe thicknesses.

Once the flanged tubular member 30 is snap fit to the clutch member 32, as just described, it is resistant to accidental disconnection. Thus, the protector is now in place and can remain as such indefinitely. In order to remove the protector from the earlobe all that is required is to pull its two components, i.e., the flanged tubular member 30 and the clutch member 32, apart.

With the protector 20 in place as just described it is now ready to accommodate the pierced earring 22 therein. To that end the post 28 of the pierced earring is inserted into the central passageway 38 of the flanged tubular member 30. The earring is then pushed deeper into the protector 20 so that the pointed free end of the post exits the free end of the flanged tubular member 30 and enters the hollow interior passageway 60 of the rear portion 52 of the clutch member 32. Continued pushing of the earring causes the pointed free end of its post to slide up the inclined front surface 66 of each of the projections 64 and over the top surfaces 68 thereof until the free end of the post extends out of the rear of the clutch member. The springy nature of the fingers supporting the projections 64 enables the projections to flex outward to enable the passage of the earring post over the top surface of the projections, yet to provide sufficient bias to ensure that the top surface of the projections frictionally engages the outer surface of the post contiguous therewith. This action frictionally holds the earring in place against accidental displacement, and without requiring the use of the earring's retainer back or any other retention means.

In order to remove the earring 22 from the protector 20, e.g., to replace that earring with another earring, all that is required is to pull on the front 26 of the earring to overcome the frictional engagement between the projections in the clutch member and the earring's post, whereupon the earring will slide out of the protector.

Without further elaboration the foregoing will so fully illustrate my invention that others may, by applying current or future knowledge, adopt the same for use under various conditions of service.

I claim:

1. A pierced earlobe protector for disposition within an opening extending through the earlobe of a person from the front surface of the earlobe to the rear surface thereof, said protector being arranged to hold a conventional pierced earring including a decorative portion and a post projecting therefrom, said protector comprising a clutch member and a flanged tubular member, said clutch member comprising a flanged front portion, a rear portion, and a central passageway extending through said clutch member and having at least one projection extending into said central passageway, said flanged tubular member having a flanged front portion and an elongated rear portion, said elongated rear portion having a free end and being arranged to be extended through the opening in the person's earlobe, said flanged tubular member also having a central passageway extending therethrough, said flanged front portion of said flanged tubular member being arranged for disposition adjacent the front surface of the earlobe when said elongated rear portion of said flanged tubular member is extended through the opening in the earlobe, said free end of said elongated rear portion including an outer surface and at least one annular recess extending about said outer surface for snap-fitting receipt of a portion of said clutch member therein to releasably secure said flanged tubular member to said clutch member wherein the spacing between the flanged front portion of said flanged tubular member and said flanged portion of said clutch member is adjustable and wherein said flanged portion of said clutch member is located adjacent the rear surface of the earlobe to prevent said protector from becoming dislodged out of the earlobe opening, the post of the earring being arranged to be extended through said central passageway in said flanged tubular member and into said central passageway in said clutch member to be frictionally engaged by said at least one projection.

2. The protector of claim 1 wherein said at least one recess comprises a pair of annular recesses, each disposed about the outer surface of said free end of said elongated rear portion to enable the spacing between said flanged front portion of said flanged tubular member and said flanged portion of said clutch member to be adjusted.

3. The protector of claim 1 wherein said flanged tubular member is formed of titanium.

4. The protector of claim 3 wherein said flanged portion of said clutch member is formed of titanium, and wherein said at least one projection is formed of beryllium copper.

5. A pierced earlobe protector for disposition within an opening extending through the earlobe of a person from the front surface of the earlobe to the rear surface thereof, said protector being arranged to hold a conventional pierced earring including a decorative portion and a post projecting therefrom, said protector comprising a clutch member and a flanged tubular member, said clutch member comprising a flanged front portion, a rear portion, and a central passageway extending through said clutch member and having at least one protection extending into said central passageway, said flanged tubular member having a flanged front portion and an elongated rear portion, said elongated rear portion having a free end and being arranged to be extended through the opening in the person's earlobe, said flanged tubular member also having a central passageway extending therethrough, said flanged front portion of said flanged tubular member being arranged for disposition adjacent the front surface of the earlobe when said elongated rear portion of said flanged tubular member is extended through the opening in the earlobe, said free end of said elongated rear portion including at least one recess therein extending about said outer surface for receipt of a portion of said clutch member to snap fit said flanged tubular member to said clutch member, whereupon said flanged portion of said clutch member is located adjacent the rear surface of the earlobe to prevent said protector from becoming dislodged out of the earlobe opening, the post of the earring being arranged to be extended through said central passageway in said flanged tubular member and into said central passageway in said clutch member to be frictionally engaged by said at least one projection, said clutch member including at least one slot extending longitudinally therethrough to form a spring finger on which said at least one projection is located to facilitate the frictional engagement of said at least one projection with the post of the pierced earring.

6. The protector of claim 5 wherein said free end of said elongated rear portion of said flanged tubular member includes at least one slot therein to facilitate the introduction thereof into said central passageway of said clutch member.

7. The protector of claim 6 wherein said free end of said flanged tubular member is chamfered to facilitate the introduction of said free end of said elongated portion of said flanged tubular member into said central passageway of said clutch member.

8. A pierced earlobe protector for disposition within an opening extending through the earlobe of a person from the front surface of the earlobe to the rear surface thereof, said protector being arranged to hold a conventional pierced earring including a decorative portion and a post projecting therefrom, said protector comprising a clutch member and a flanged tubular member, said clutch member comprising a flanged front portion, a rear portion, and a central passageway extending through said clutch member and having at least one projection extending into said central passageway, said flanged tubular member having a flanged front portion and an elongated rear portion, said elongated rear portion having a free end and being arranged to be extended through the opening in the person's earlobe, said flanged tubular member also having a central passageway extending therethrough, said flanged front portion of said flanged tubular member being arranged for disposition adjacent the front surface of the earlobe when said elongated rear portion of said flanged tubular member is extended through the opening in the earlobe, said free end of said elongated rear portion including at least one recess therein extending about said outer surface for receipt of a portion of said clutch member to snap fit said flanged tubular member to said clutch member, whereupon said flanged portion of said clutch member is located adjacent the rear surface of the earlobe to prevent said protector from becoming dislodged out of the earlobe opening, the post of the earring being arranged to be extended through said central passageway in said flanged tubular member and into said central passageway in said clutch member to be frictionally engaged by said at least one projection, said free end of said elongated rear portion of said flanged tubular member including at least one slot therein to facilitate the introduction thereof into said central passageway of said clutch member.

9. A pierced earlobe protector for disposition within an opening extending through the earlobe of a person from the front surface of the earlobe to the rear surface thereof, said protector being arranged to hold a conventional pierced earring including a decorative portion and a post projecting therefrom, said protector comprising a clutch member and a flanged tubular member, said clutch member comprising a flanged front portion, a rear portion, and a central passageway extending through said clutch member and having at least one projection extending into said central passageway, said flanged tubular member having a flanged front portion and an elongated rear portion, said elongated rear portion having a free end and being arranged to be extended through the opening in the person's earlobe, said flanged tubular member also having a central passageway extending therethrough, said flanged front portion of said flanged tubular member being arranged for disposition adjacent the front surface of the earlobe when said elongated rear portion of said flanged tubular member is extended through the opening in the earlobe, said free end of said elongated rear portion including at least one recess therein extending about said outer surface for receipt of a portion of said clutch member to snap fit said flanged tubular member to said clutch member, whereupon said flanged portion of said clutch member is located adjacent the rear surface of the earlobe to prevent said protector from becoming dislodged out of the earlobe opening, the post of the earring being arranged to be extended through said central passageway in said flanged tubular member and into said central passageway in said clutch member to be frictionally engaged by said at least one projection, said free end of said flanged tubular member being chamfered to facilitate the introduction of said free end of said elongated rear portion of said flanged tubular member into said central passageway of said clutch member.

* * * * *